US007730882B2

(12) United States Patent
Liu

(10) Patent No.: US 7,730,882 B2
(45) Date of Patent: Jun. 8, 2010

(54) CARTRIDGE RETAINING DEVICE FOR HAND GUN

(76) Inventor: Chin-Chi Liu, 10F, No. 32, Guang Jou Street, Taipei (TW)

( * ) Notice: Subject to any disclaimer, the term of this patent is extended or adjusted under 35 U.S.C. 154(b) by 662 days.

(21) Appl. No.: 11/639,262

(22) Filed: Dec. 15, 2006

(65) Prior Publication Data

US 2008/0141991 A1 Jun. 19, 2008

(51) Int. Cl.
*F41B 11/00* (2006.01)

(52) U.S. Cl. ..... 124/74

(58) Field of Classification Search ..... 124/57, 124/69, 80; 42/71.02–74
See application file for complete search history.

(56) References Cited

U.S. PATENT DOCUMENTS 2,725,048 A * 11/1955 Koogle ..... 124/71
3,127,885 A * 4/1964 Kline et al. ..... 124/74
3,207,143 A * 9/1965 Kline et al. ..... 124/76
3,999,534 A * 12/1976 Chapin et al. ..... 124/74
4,150,656 A * 4/1979 Curran ..... 124/74
4,344,410 A * 8/1982 Curran ..... 124/80
6,029,645 A * 2/2000 Wonisch et al. ..... 124/74
6,494,194 B2 * 12/2002 Shipachev et al. ..... 124/73
7,290,539 B2 * 11/2007 Maeda et al. ..... 124/74
2006/0260596 A1 * 11/2006 Maeda et al. ..... 124/74

* cited by examiner

*Primary Examiner*—Troy Chambers
(74) *Attorney, Agent, or Firm*—Rosenberg, Klein & Lee

(57) ABSTRACT

A gun having a gas cartridge retaining device comprises a gun device having a hand grip, and a gas cartridge retaining device disposed at the bottom of the hand grip. The hand grip has a cartridge holding chamber for receiving a gas cartridge. Pull up a camshaft lever of a gas cartridge retaining device to push the upper piston element upwardly, such that the gas cartridge is retained in a gun. Pull open the camshaft lever to release the upper piston element, such that the gas cartridge can be taken off. In this way, the gas cartridge can be installed or detached from the gun quickly.

14 Claims, 5 Drawing Sheets

CARTRIDGE RETAINING DEVICE FOR HAND GUN

BACKGROUND OF THE INVENTION

1. Field of the Invention

The present invention relates to a gas powered hand gun having a gas cartridge retaining device. The retaining device comprises a quick release and reloading camshaft mechanism for the speedy power cartridge replacement.

2. Description of Relative Prior Art

Conventional CO2 cartridge is mounted in an air gun which has a cartridge retaining device to lock the cartridge inside the gun for pellets shooting.

Referring to FIG. 1, an air gun 1*a* has a hand grip 11*a* having a cartridge storing groove 12*a*. A grip cover 3*a* is used to cover the cartridge storing groove 12*a*, a CO2 cartridge 4*a* is loaded inside the groove 12*a*. A conventional cartridge locking device 2*a* is disposed at the bottom of the hand grip 11*a*. The locking device 2*a* comprises a tightening screw 21*a* and a locking pad 22*a*. The screw 21*a* is turned inward into the groove 12*a* inside the hand grip 11*a*. Therefore, turning the screw 21*a* is to tighten and raise the pad 22*a* to lock the cartridge 12*a* in place for shooting.

After empty the gas inside the CO2 cartridge from shooting, the steps of replacing a CO2 gas cartridge 4*a* is first to remove the hand grip cover 3*a*, loosen the tightening screw 21*a* to lower the locking pad 22*a*, remove the cartridge 4*a* to empty the groove 12*a*, reload a new CO2 cartridge 4*a* in place, tighten the screw 21*a*, and then closing the grip cover 3*a*. Therefore, the replacing steps are very complex and very time consumption.

As discussed above, the prior art has a lot of drawbacks that could be improved upon. The present invention aims to resolve these drawbacks and greatly simplify the steps and at meantime reducing the time needed for the cartridge replacement action, consequently speed up the cartridge replacement to maximize the pleasure of shooting.

SUMMARY OF THE INVENTION

The object of the present invention is to provide a power gun to have a quick release cartridge retaining device for the gas power cartridge. The replacement of the gas cartridge can be accomplished by one single action of open and close the hand grip with a gas cartridge retaining device. Swivel the hand grip open to loose the used empty cartridge, replace a new cartridge and lock it in place for immediate shooting by closing a camshaft lever of the gas cartridge retaining device. Moreover there is no more protruding tightening screw at the bottom of the hand grip, the shape and appearance of the gun is more resemble to real guns to make them more attractive to the consumers.

For achieving the above object, the present invention equip with a cartridge retaining device comprising: a hand grip having a cartridge storing groove; and a gas cartridge retaining device having a pivoted camshaft lever and a retaining pad is disposed at the bottom of the hand grip. Moreover, the camshaft lever is adjunct to the grip cover.

Numerous additional features, benefits and details of the present invention are elaborated in the detail description listed below.

BRIEF DESCRIPTION OF THE DRAWINGS

The foregoing aspects and many of the attendant advantages of this invention will be more readily appreciated and clearly understood by referring to the following detailed description, when taken in conjunction with the accompanying drawings, wherein.

DETAILED DESCRIPTION OF PREFERRED EMBODIMENTS

Figure 1:
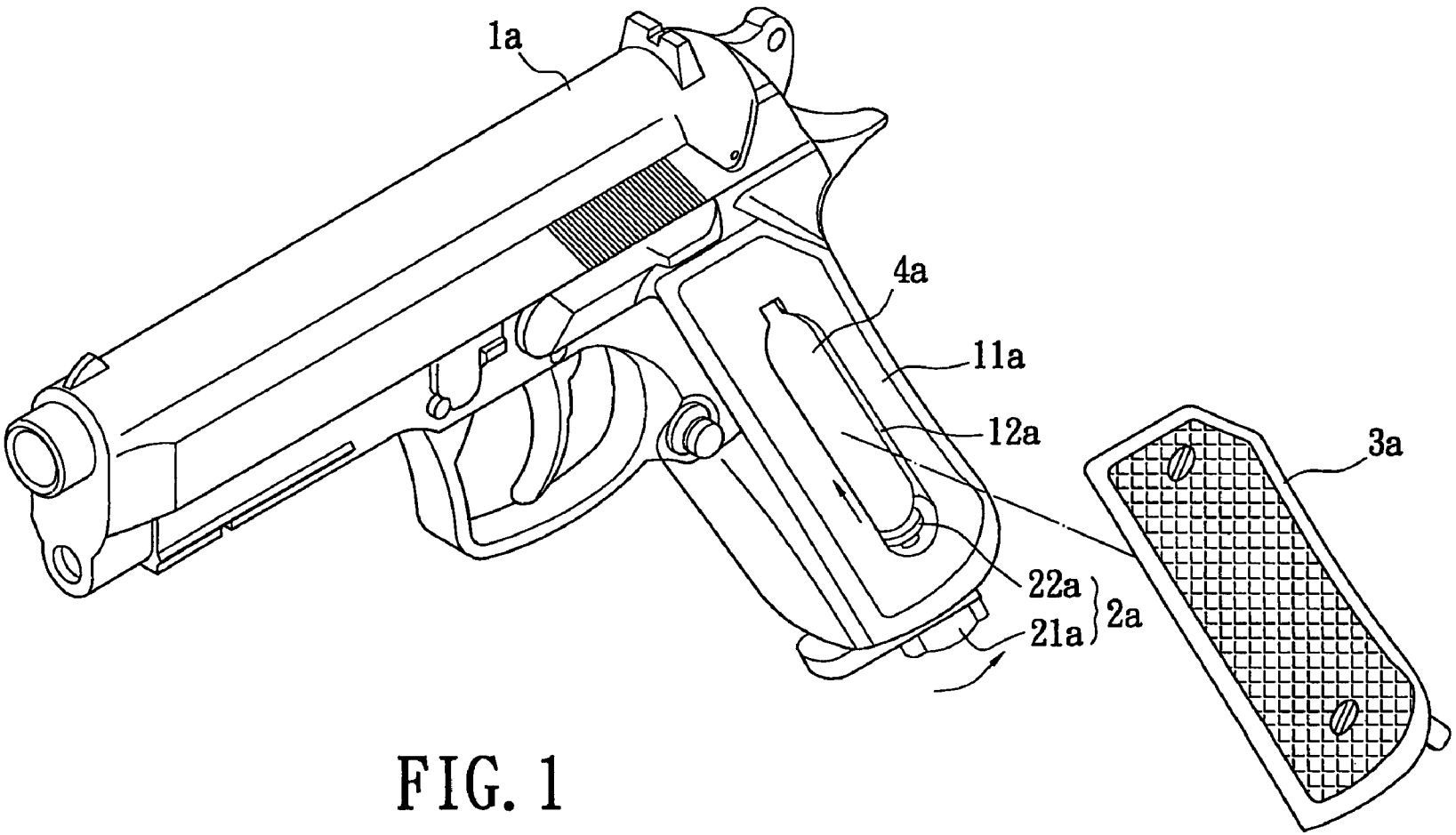
FIG. 1 PRIOR ART
FIG. 1 is a perspective view of a conventional air gun having CO2 cartridge retaining device in prior art.
Figure 2:
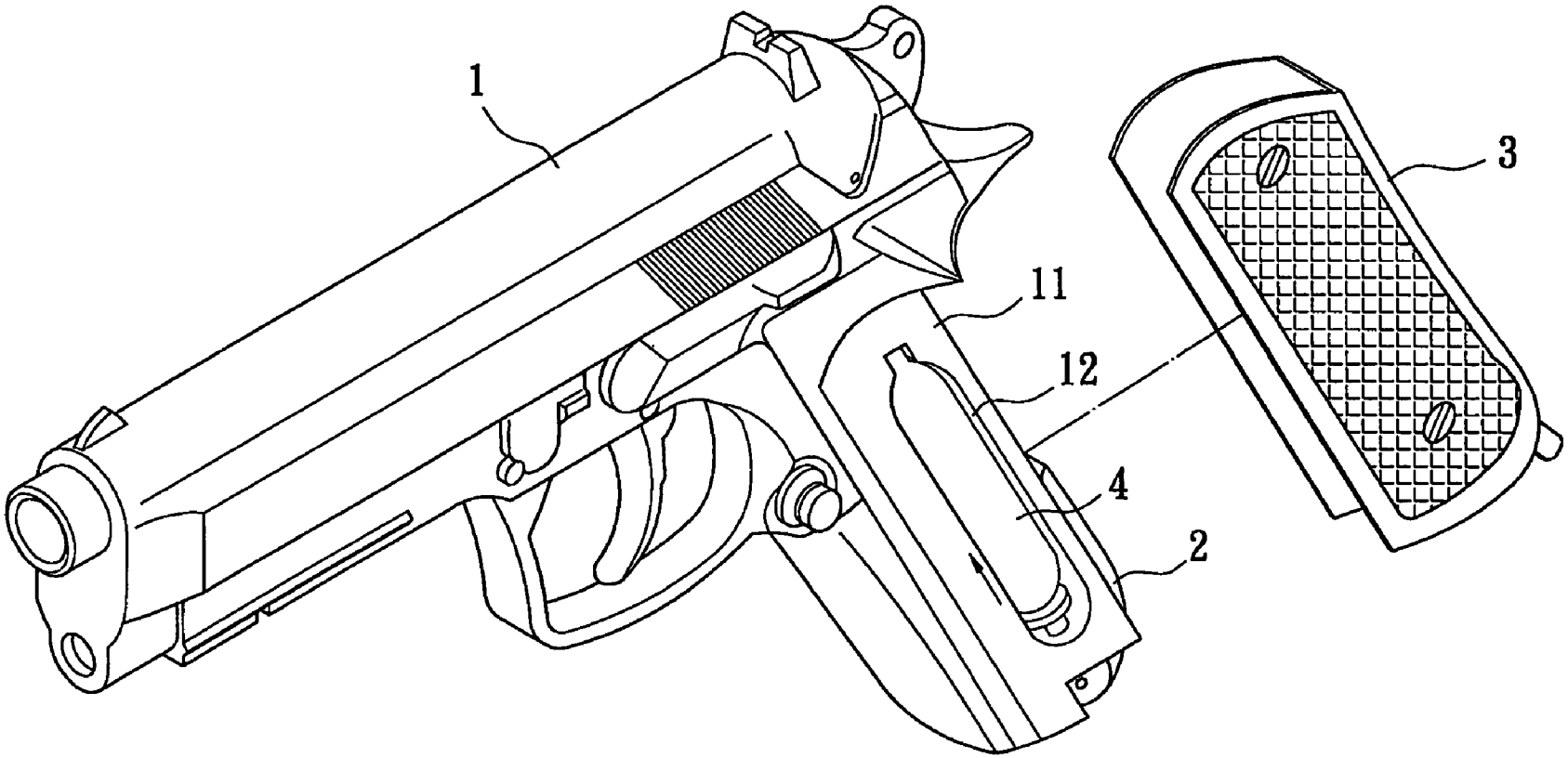
FIG. 2 is a perspective view of a gun having a gas cartridge retaining device.
Figure 3:
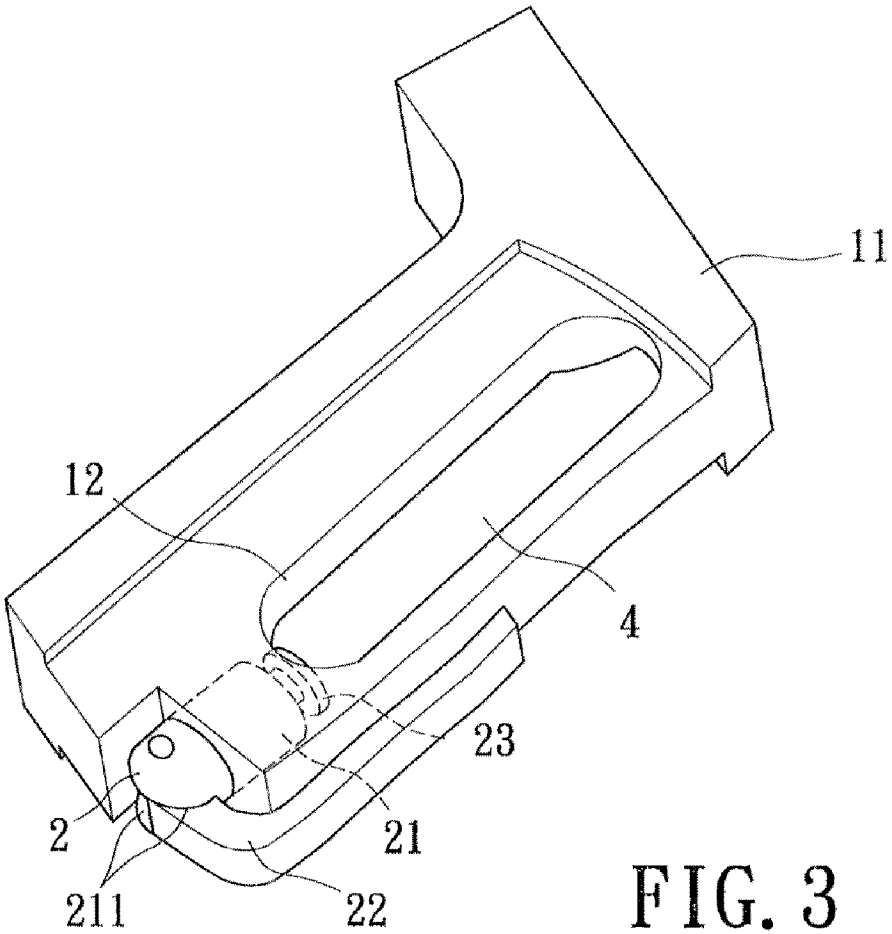
FIG. 3 is a perspective view of a hand grip and a gas cartridge retaining device of present invention.

Refer to FIG. 2 and 3; the present invention includes a gun device 1 having a gas cartridge retaining device 2, and a grip cover 3. The gun device 1 has a hand grip 11, and the hand grip 11 has a cartridge holding chamber 12 for receiving a gas cartridge 4. The gas cartridge retaining device 2 is disposed at the bottom of the hand grip 11. The gas cartridge retaining device 2 includes a bottom piston element 21, a camshaft lever 22, and an upper piston element 23. The bottom piston element 21 is fixed on the bottom of the hand grip 11. Pull up the camshaft lever 22 away from the side of the cartridge holding chamber 12 to advance the upper piston element 23, and than the gas cartridge 4 will be retained by the pushing portion 23 and the top surface of the cartridge holding chamber 12. The grip cover 3 is fixed to the side of the camshaft lever 22, and grip cover 3 covers the cartridge holding chamber 12.

Figure 5:
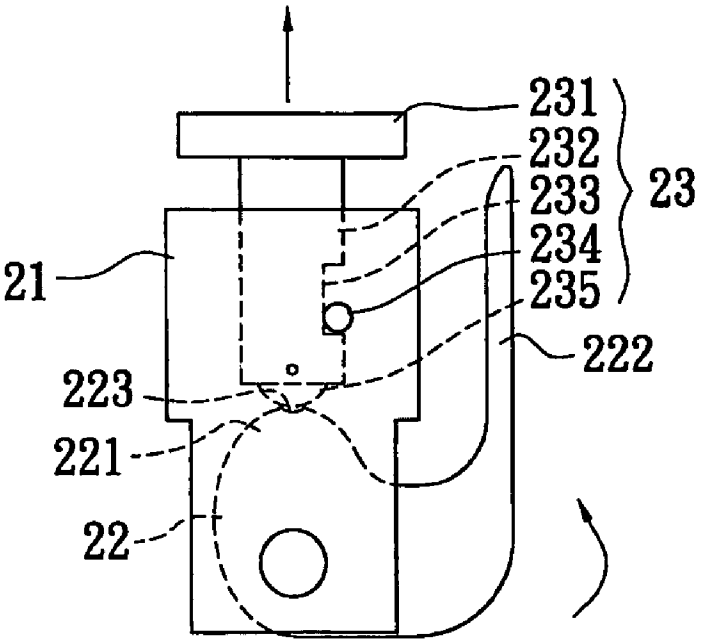
FIG. 5 is a schematic diagram of a camshaft lever cylinder retaining device in closed position.
Figure 4:
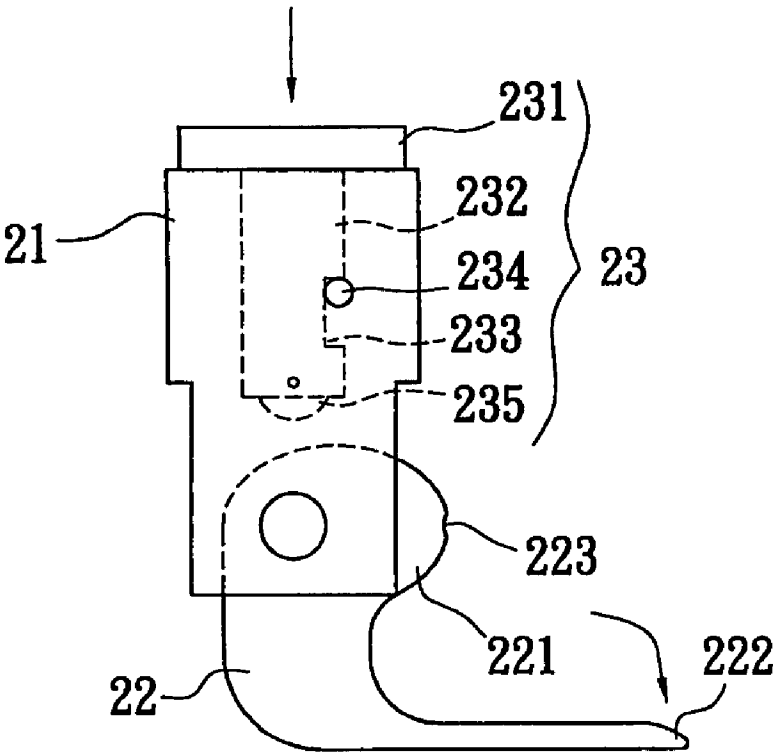
FIG. 4 is a schematic diagram of camshaft lever cylinder retaining device in the opening position.

Refer to FIGS. 4 and 5; the details of the gas cartridge retaining device 2 are described below.

The bottom piston element 21 is a tube shape. The bottom of the bottom piston element 21 has two tabs 211 extending thereof. The top of the camshaft lever 22 is disposed between the tabs 211. The upper piston element 23 is slidably disposed in the bottom piston element 21, and the top of the upper piston element 23 extends into the cartridge holding chamber 12. In another embodiment, the bottom piston element 21 is integrated with the hand grip 2.

The upper piston element 23 includes a locking pad 231 and a column 232. The locking pad 231 is disposed on the top of the column 232, and the shape of the top of the locking pad 231 can be fitting with the shape of the bottom of the gas cartridge 4. The column 232 is disposed slidably in the bottom piston element 21. The column 232 has a groove 233. A post 234 penetrates through the bottom piston element 21 and the groove 233 for limit the movement of the column 232 in the bottom piston element 21.

Figure 6:
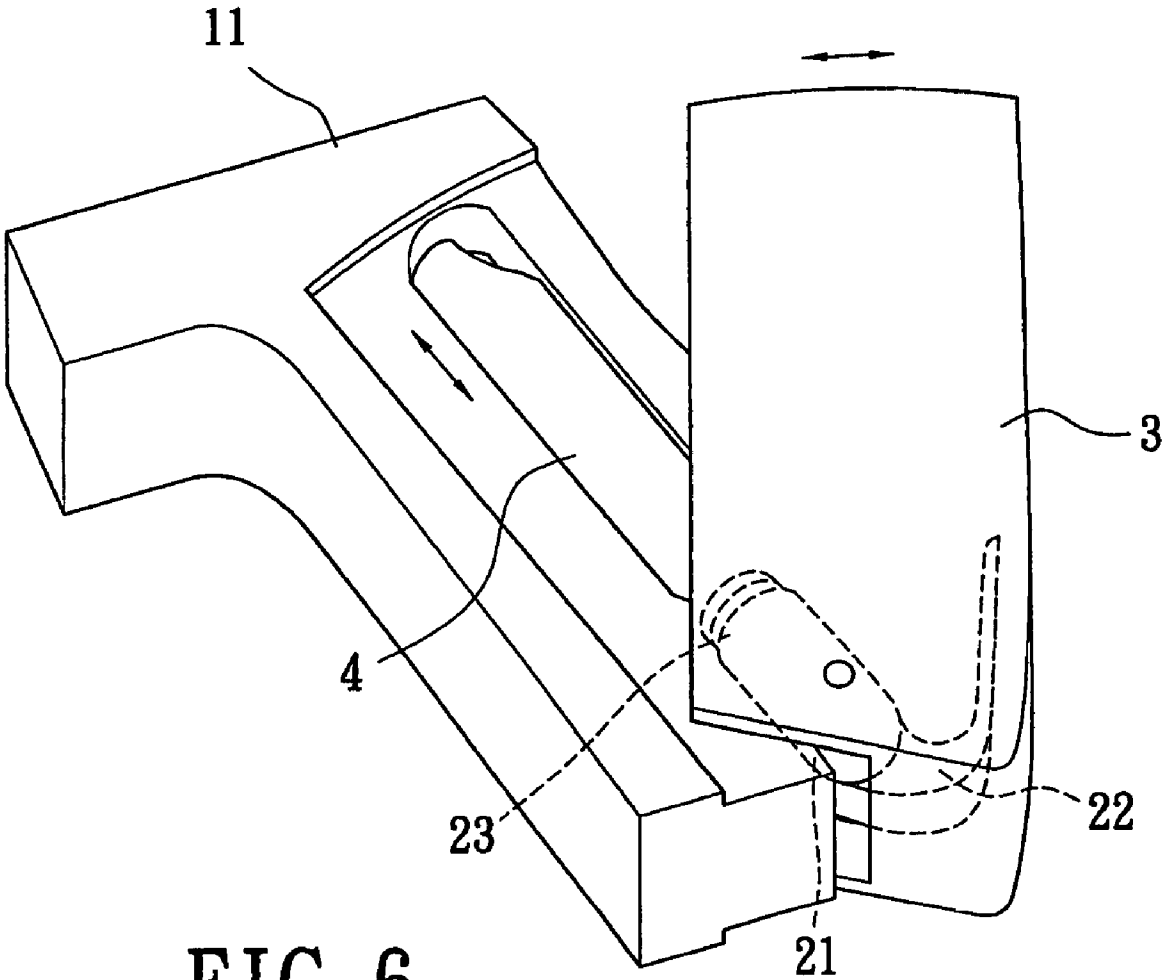
FIG. 6 is a perspective view of a camshaft lever adjunct to the grip cover.

The camshaft lever 22 has a rib 221 and an arm 222. The rib 221 and the arm 222 extend perpendicularly from the camshaft lever 22 in the same direction. Pull up the arm 222 to a fasten position (as shown in FIG. 5), and the rib 221 will push the bottom of the column 232 upwardly. Pull open the arm 222 to a releasing position (as shown in FIG. 6). The rib 221 will not push the bottom of the column 232, and the pushing portion 23 can be moveable.

In this embodiment, the rib 221 has a recess 223, and a wheel 235 is piloted on the bottom of the column 232. When the rib 221 is pushing the bottom of the column 232, and the rib will be sliding along wheel 235. Therefore, the rotation of the camshaft lever 22 can be smoothly. Moreover, when the arm 222 to a fasten position, the wheel 235 will be fall into the recess 223. Therefore, the position of the camshaft lever 22 can be fixed.

Refer to FIG. 6, the grip cover 3 is fixed with the arm 222 and pivoted by coupling with the tabs 211 (shown more clearly in FIG. 3) of the bottom piston element 21 and the camshaft lever 22. The gas cartridge 4 is disposed in the cartridge holding chamber 12. When close the grip cover 3 for covering over the cartridge holding chamber 12, the gas cartridge retaining device 2 push the gas cartridge 4 upwardly, and the gas cartridge 4 is held by the gas cartridge retaining device 2 and the top surface of the cartridge holding chamber 12. When open the grip cover 3, the upper piston element 23 is moveable and releases the space for taking off the gas cartridge 4. In the other embodiment, the grip cover 3 is integrated with the camshaft lever 22.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A gun having a gas cartridge retaining device, comprising:

a gun device having a hand grip, and the hand grip having a cartridge holding chamber; and a gas cartridge retaining device disposed at a bottom of the hand grip, and the gas cartridge retaining device including an upper piston element and a camshaft lever, the camshaft lever being displaceable to push the upper piston element upwardly, the gas cartridge retaining device including a bottom piston element fixed on the bottom of the hand grip, the upper piston element being slidably disposed in the bottom piston element, a top of the upper piston element extending into the cartridge holding chamber, and the camshaft lever being pivotally coupled to a bottom portion of the bottom piston element, the upper piston element including a column and the column being slidably disposed in the bottom piston element, the column having a groove, and a post penetrates through the bottom piston element and extends into the groove to limit the movement of the column in the bottom piston element.

2. The gun as claimed in claim 1 further includes a grip cover for covering the cartridge holding chamber, and the grip cover overlays the camshaft lever.

3. The gun as claimed in claim 1 further includes a grip cover for covering the cartridge holding chamber, and the grip cover is coupled to the camshaft lever.

4. The gun as claimed in claim 1, wherein the camshaft lever has a rib and an arm, and when the arm is displaced to a fasten position, the rib pushes the bottom of the upper piston element thereby moving it upwardly, and displacing the arm to a releasing position releases the upper piston element.

5. The gun as claimed in claim 4, wherein the rib has a recess, and a wheel is disposed on the bottom of the upper piston element, whereby as the rib is pushing the bottom of the upper piston element upwardly, the rib is concurrently sliding along the wheel.

6. The gun as claimed in claim 5, wherein when the arm moves to the fasten position, the wheel falls into the recess of the rib for fixing the position of the camshaft lever.

7. The gun as claimed in claim 1, wherein the bottom piston element is integrated with the hand grip.

8. A gun having a gas cartridge retaining device, comprising:

a gun device having a hand grip and the hand grip having a cartridge holding chamber;

a gas cartridge retaining device disposed at the bottom of the hand grip, the gas cartridge retaining device including an upper piston element, a bottom piston element fixed on the bottom of the hand grip, a camshaft lever pivoted on the bottom of the bottom piston element and a grip cover, the upper piston element including a column and the column being slidably disposed in the bottom piston element, the column having a groove, and a post penetrates through the bottom piston element and the groove to limit the movement of the column in the bottom piston element;

wherein the grip cover is closed for covering the cartridge holding chamber and displacing the upper piston element upwardly, and the grip cover being opened for uncovering the cartridge holding chamber and lowering the upper piston element.

9. The gun as claimed in claim 8, wherein the grip cover overlays the camshaft lever.

10. The gun as claimed in claim 8, wherein the grip cover is coupled to the camshaft lever.

11. The gun as claimed in claim 8, wherein the camshaft lever has a rib and an arm, and when the arm is displaced to a fasten position, the rib pushes the bottom of the upper piston element thereby moving it upwardly, and displacing the arm to a releasing position lowering the upper piston element.

12. The gun as claimed in claim 11, wherein the rib has a recess, and a wheel is disposed on the bottom of the upper piston element, whereby as the rib is pushing the bottom of the upper piston element, the rib is concurrently sliding along the wheel.

13. The gun as claimed in claim 12, wherein when the arm moves to the fasten position, the wheel falls into the recess of the rib for fixing the position of the camshaft lever.

14. The gun as claimed in claim 8, wherein the bottom piston element is coupled to the hand grip.

* * * * *